US005383297A

United States Patent [19]

Summerville et al.

[11] Patent Number: 5,383,297

[45] Date of Patent: Jan. 24, 1995

[54] VENDOR SELECTION PANEL ASSSEMBLY

[75] Inventors: Don S. Summerville, Snellville; Lionel D. Gillespie; Steven C. Gamper, both of Atlanta, all of Ga.

[73] Assignee: The Coca-Cola Company, Atlanta, Ga.

[21] Appl. No.: 827,275

[22] Filed: Jan. 29, 1992

[51] Int. Cl.[6] ..... G09F 7/02

[52] U.S. Cl. ..... 40/611; 40/575; 312/234.2

[58] Field of Search ..... 40/584, 573, 541, 312, 40/575, 319, 5, 158.1, 159, 611, 642; 194/350; 312/114, 265.6, 234.2

[56] References Cited

U.S. PATENT DOCUMENTS

| | | | |
|---|---|---|---|
| D. 294,716 | 3/1988 | Morgan, Jr. . | |
| 2,587,434 | 2/1952 | Boaden et al. | 40/159 |
| 2,588,545 | 3/1952 | Lawrence | 40/152.2 |
| 2,707,346 | 5/1955 | Fuller, Jr. . | |
| 2,799,107 | 7/1957 | McArthur | 40/159 |
| 2,858,629 | 11/1958 | Carter | 40/152.2 |
| 3,797,152 | 3/1974 | Brandt | 40/159 X |
| 4,073,612 | 2/1978 | Nitta | 40/642 |
| 4,217,711 | 8/1980 | Spresser et al. | 40/159 X |
| 4,292,752 | 10/1981 | Clark . | |
| 4,316,337 | 2/1982 | DaCosta . | |
| 4,377,049 | 3/1983 | Simon et al. | 40/491 X |
| 4,380,130 | 4/1983 | Bachmann et al. | 40/584 |
| 4,424,637 | 1/1984 | Leahy | 40/152 |
| 4,454,670 | 6/1984 | Bachmann et al. | 40/584 |
| 4,682,709 | 7/1987 | Brandes et al. . | |
| 4,761,903 | 8/1988 | Cantrell | 40/159 |
| 4,794,716 | 1/1989 | George et al. | 40/159 X |
| 4,973,109 | 11/1990 | Diedrich | 194/350 X |
| 5,148,618 | 9/1992 | Brewster | 40/152 X |

FOREIGN PATENT DOCUMENTS

3600588C2 2/1987 Germany .

*Primary Examiner*—Brian K. Green

[57] ABSTRACT

A lattice type carrier for separate product identification labels and package size/price labels. The carrier is secured to the back of a vandal resistant front selection panel having one or more transparent windows for the labels mounted on the carrier. The carrier, moreover, includes an arrangement of generally rectangular frame type openings wherein translucent product identification labels are mounted and back lighted. Also, the package size/price labels may either be mounted in relatively smaller frame type openings in the carrier above the respective product identification labels or adhesively mounted to the front surface of the carrier or above the product identification areas.

9 Claims, 4 Drawing Sheets

VENDOR SELECTION PANEL ASSSEMBLY

BACKGROUND OF THE INVENTION

The present invention relates to coin operated vending machine apparatus for soft drink bottles or cans, and more particularly to back lighted vendor selection panel assemblies therefor, including changeable labels for product identification, package size and price.

The majority of conventional soft drink vending apparatus permits only one package size to be vended in each machine. In addition, the control systems in these vending machines require that each selection have the same vend price. This type of equipment is referred to as single price vending equipment. In this single price environment, it is only necessary to inform the consumer of the product associated with each selection button. Since all packages and prices are identical, a central price/package label is adequate to inform the consumer of this critical information.

New generation vending equipment, however, features flexible vend mechanisms that allow multiple size and design packages to be used in a single machine. In addition, new control system designs permit each selection to have a unique vend price.

These new capabilities require that each selection's flavor, package size and price be communicated to the consumer. One method to achieve this in existing equipment is to add this information to the flavor label. This approach, however, has many operational, cost and inventory deficiencies since labels for a given flavor would have to be printed on all possible package and price combinations. This necessitates either a new product label size or a greatly reduced flavor trademark identification area. These solutions provide inherent limitations which are not acceptable in terms of flavor label inventory issues and consumer communications issues.

Equipment designs of the prior art are known to include label retention means in the vending machine front selection panel. However, this requirement mandates an injection molded part with molded label retention devices. These retention devices and the general layout of components in the door of the vending machine make it extremely difficult to gain access to the product labels for initial set up at the factory or changes in the field. This restriction, moreover, limits the practical thickness of the front selection panel and creates voids in openings in the panel which weaken this area of the machine. These weak points are known to have become specific target areas for vandals in their efforts to gain unauthorized entry into the vending machine.

SUMMARY OF THE INVENTION

Accordingly, it is a primary object of the present invention to overcome the shortcomings of existing vending machine designs by separating the product label retaining function from the front selection panel.

It is another object of the present invention to provide for a separate label carrier in conjunction with the front panel to provide for quick removal and easy changing of identification, size and pricing labels for the product being vended.

It is a further object of the invention to provide a relatively simple and more vandal resistant front selection panel assembly.

It is still another object of the invention to provide a front panel assembly which includes a carrier for both single and multi-price package applications as well as separate label areas therefor.

These and other objects are achieved in a preferred embodiment by means of a lattice type carrier for separate package/price labels and product identification labels and which is secured to a vandal resistant front selection panel having one or more transparent windows for the labels mounted on the carrier. The carrier, moreover, includes an arrangement of generally rectangular frame type openings wherein translucent product identification labels are mounted and back lighted. Also, the package size/price labels may either be mounted in relatively smaller frame type openings in the carrier above the respective product identification labels or adhesively mounted to the front surface of the carrier or above the product identification areas.

BRIEF DESCRIPTION OF THE DRAWINGS

The following detailed description of the invention will be more readily understood when considered together with the accompanying drawings in which.

DETAILED DESCRIPTION OF PREFERRED EMBODIMENTS

Figure 1:
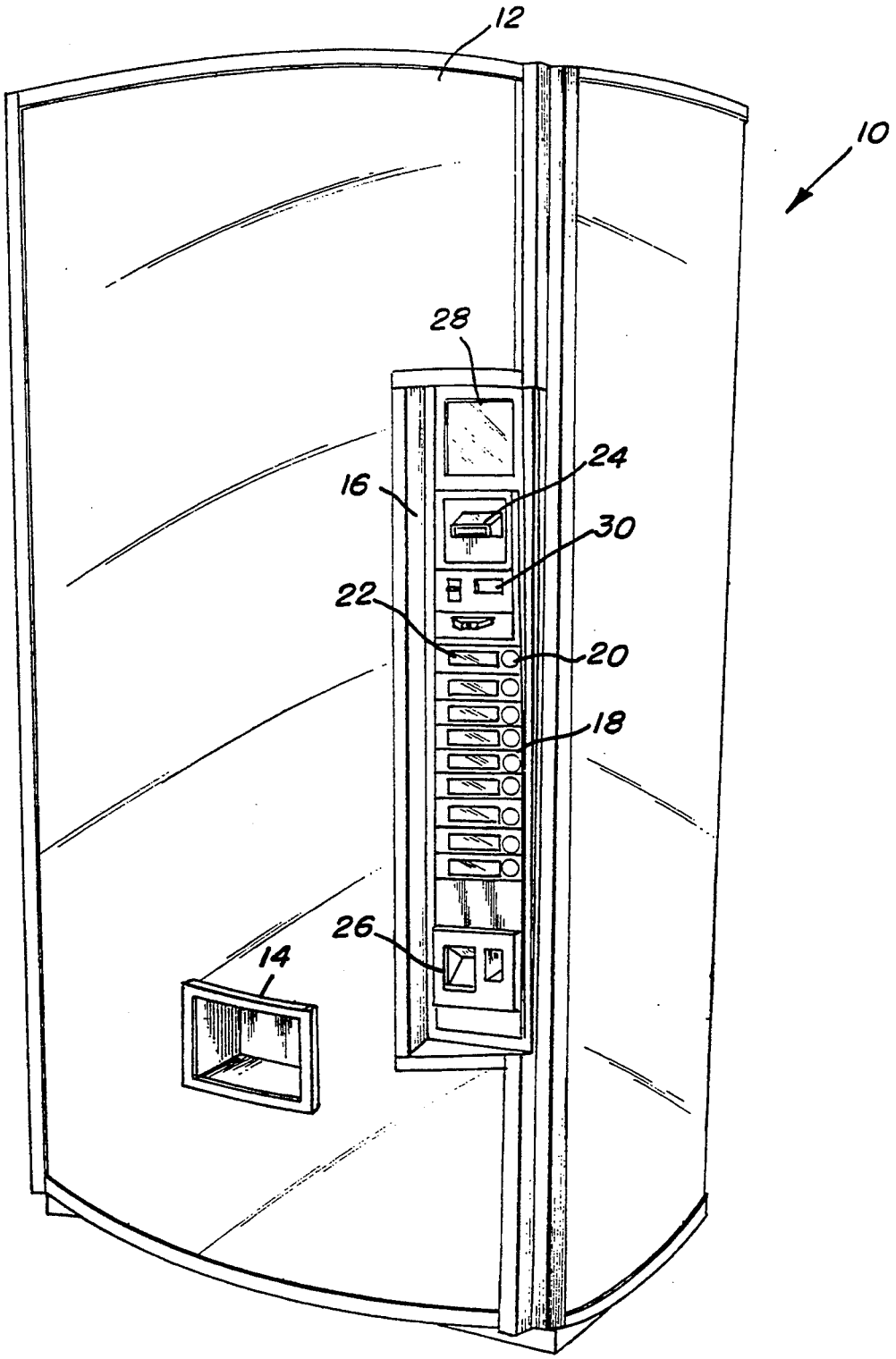
FIG. 1 (PRIOR ART)
FIG. 1 is a perspective view of a known prior art vending machine which includes a vendor selection panel in the front portion thereof.

Referring now to the drawings and more particularly to FIG. 1, shown thereat is a conventional vending machine 10 which is generally illustrated as a substantially rectangular three dimensional cabinet having a hinged front door 12 which permits access into the interior for loading and/or repairing the vending machine. Various flavors of soft drinks are delivered in cans to the consumer via a discharge port 14 in the lower portion of the door 12.

To the side of the door 12 is an upright rectangular area 16 which includes, among other things, a multi flavor selection panel 18 including a plurality of selection buttons 20 and respective flavor label windows 22, behind which are mounted a product identification label, not shown. When desirable, these product identification labels may be back lighted. Back lighting is generally known and is disclosed, for example, in U.S. Pat. No. 4,682,709, entitled, "Coin-Operated Vending Machine" issued to John H. Brandes et al on Jul. 28, 1987. The details of this patent are meant to be specifically incorporated herein by reference. In addition to the selection panel 18, there is also provided a coin insertion slot 24 and a coin return 26. Also, there is provided a point of sale information window 28 and a pricing information window 30.

As noted above, the front selection panel 18 has heretofore included label retention means, not shown, directly affixed to the rear side of the panel 18. In addition to complicating the injection molding process used to manufacture this type of selection panel, inherent structural weaknesses are built into the structure which become target points for vandalizing the vending machine 12 in an effort to gain entry into the machine for robbing the machine of its money and/or products contained therein.

This now leads to a consideration of the preferred embodiments of the invention which are directed to an assembly having a separate product and/or pricing label retention device which is secured to the back side of a stronger and more vandal resistant front panel member.

Figure 2:
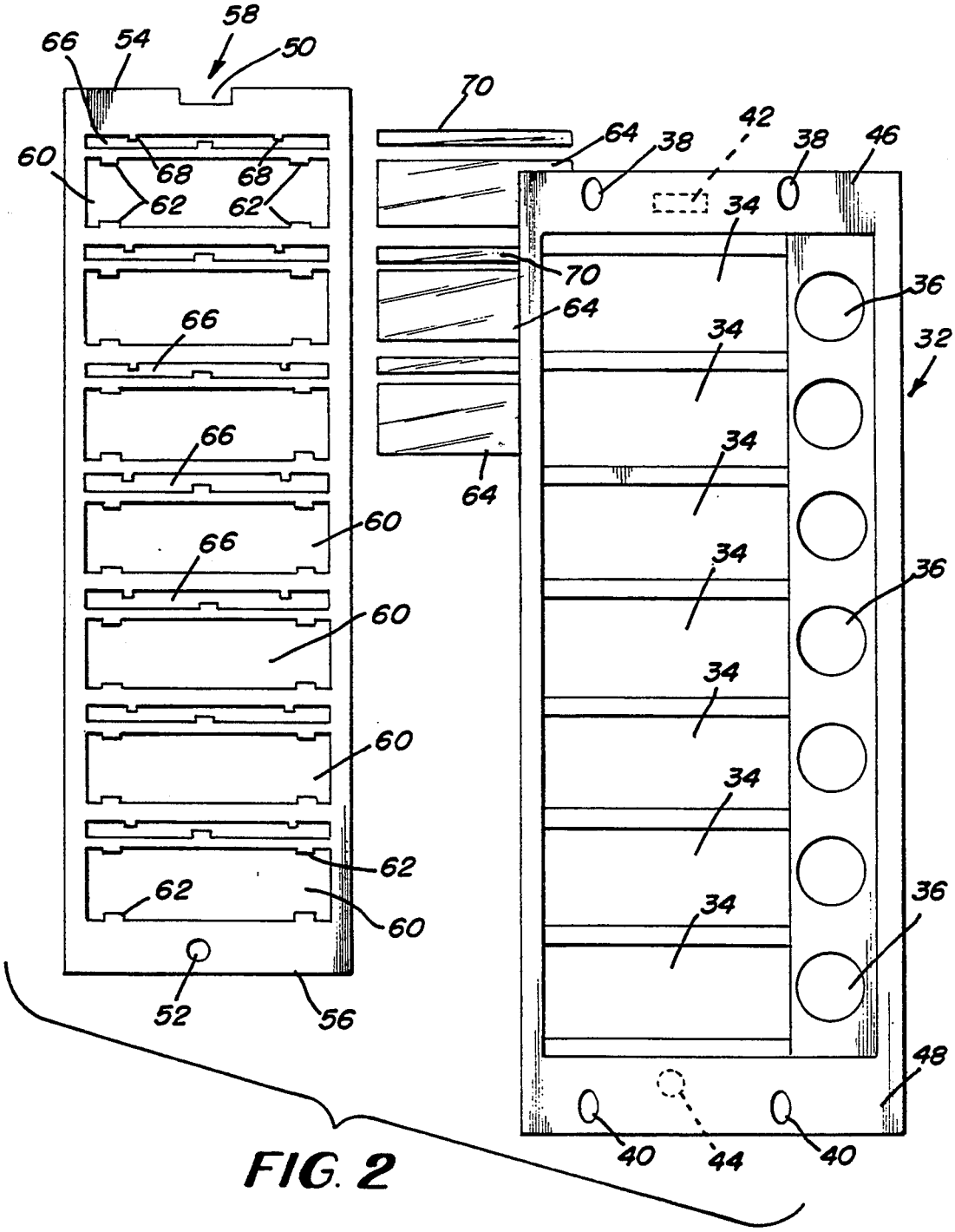
FIG. 2 is an exploded view of one preferred embodiment of the invention.

Referring now to FIG. 2, shown thereat is an exploded view of a first embodiment of the invention comprised of a generally rectangular vendor selection panel 32 constructed from a relatively strong, thick machined polycarbonate sheet as opposed to being an injection molded type element. The panel 32 may be colored or clear; however, it necessarily includes a plurality of transparent windows 34 which are generally rectangular in shape and are situated next to a respective number of push button holes 36, through which a set of product selection push buttons, not shown, project or are otherwise located for manual activation by a consumer. The panel, moreover, includes an upper and lower set of mounting holes 38 and 40 for attachment to the front wall or door member of a vending machine, not shown.

Figure 3:
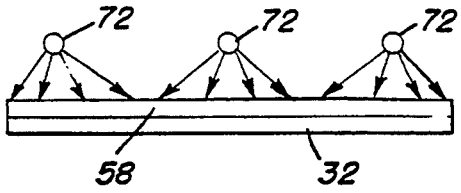
FIG. 3 is a top plan view illustrative of back lighting of the embodiment shown in FIG. 2.

A mounting tab 42 of generally rectangular cross section and a mounting stud 44 of generally circular cross section, project from the back side of the generally horizontal top and bottom body portions 46 and 48 of the front panel member 32 for engaging a mounting notch 50 and a mounting hole 52 in corresponding top and bottom body portions 54 and 56 of a generally rectangular lattice type of label carrier 58 located behind the panel 32. The label carrier 58 includes a plurality of relatively larger rectangular frame openings 60 having a plurality of small tabs 62 for holding and retaining respective translucent product identification labels 64 therein. Above each label frame 60 is a corresponding relatively smaller rectangular frame opening 66 including one or more retention tabs 68 for holding a package price label 70 in place and which is also translucent. The carrier 58 is, moreover, constructed of a darkened, e.g. black material or is otherwise exteriorally painted in a dark color, which results in the visual appearance of a separate product identification label 60 and a size/pricing label 70 surrounded by a contrasting dark frame. As noted, the labels 64 and 70 comprise translucent labels which allow them to be back lighted. This is illustrated in FIG. 3, where, for example, one or more light sources 72 provide uniform illumination to the back of the carrier 58 when mounted in position to the rear of the front panel 32.

The carrier 58 is thus adapted for quick and easy removal as a unit from the front panel 32. This permits for easy "out of the machine" access to the labels 64 and 70 by factory and/or service personnel in the field. Since all of the label mounting details are included in the carrier 58, the front selection panel 32 becomes a very simple structure, permitting the removal of all heretofore required reliefs, tabs and unnecessary openings. Such a configuration results in a panel assembly member which inherently becomes stronger and easier to manufacture.

Figure 4:
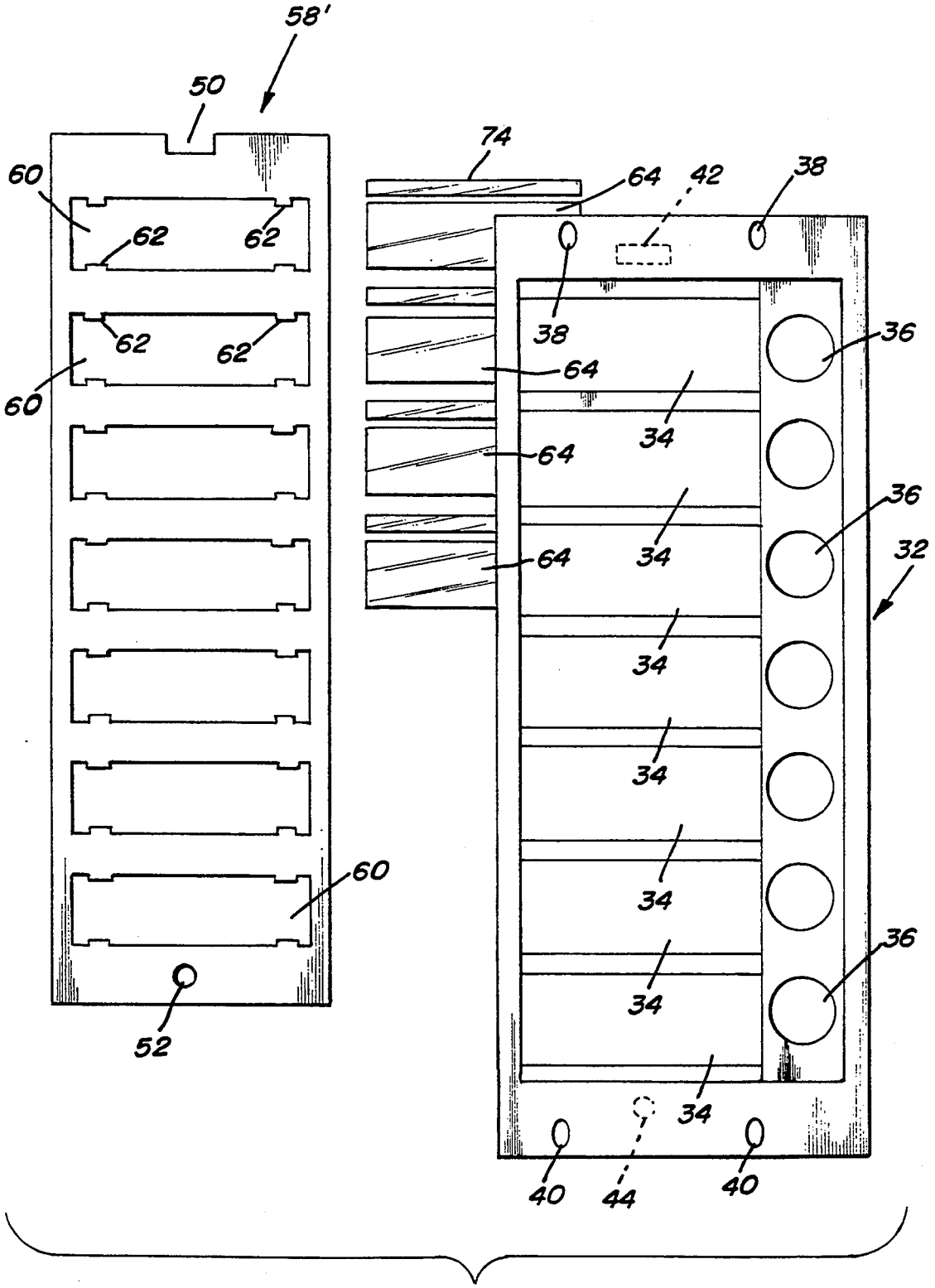
FIG. 4 is a top plan view of another preferred embodiment of the invention.

Referring now to FIG. 4, shown thereat is a modification of the embodiment shown in FIG. 2, wherein the translucent product size/price label 70 is replaced by an adhesive strip type label 74. This is accompanied by the removal of the small rectangular frame openings 66 in the carrier 58 to provide a carrier structure 58′ which has solid surface portions above the respective identification label openings 60 for the attachment of the adhesive labels 74 including size/price information. In all other respects this embodiment is like that shown in FIG. 2 and which furthermore permits the product identification labels 64 to be back lighted as shown in FIG. 3.

Figure 5:
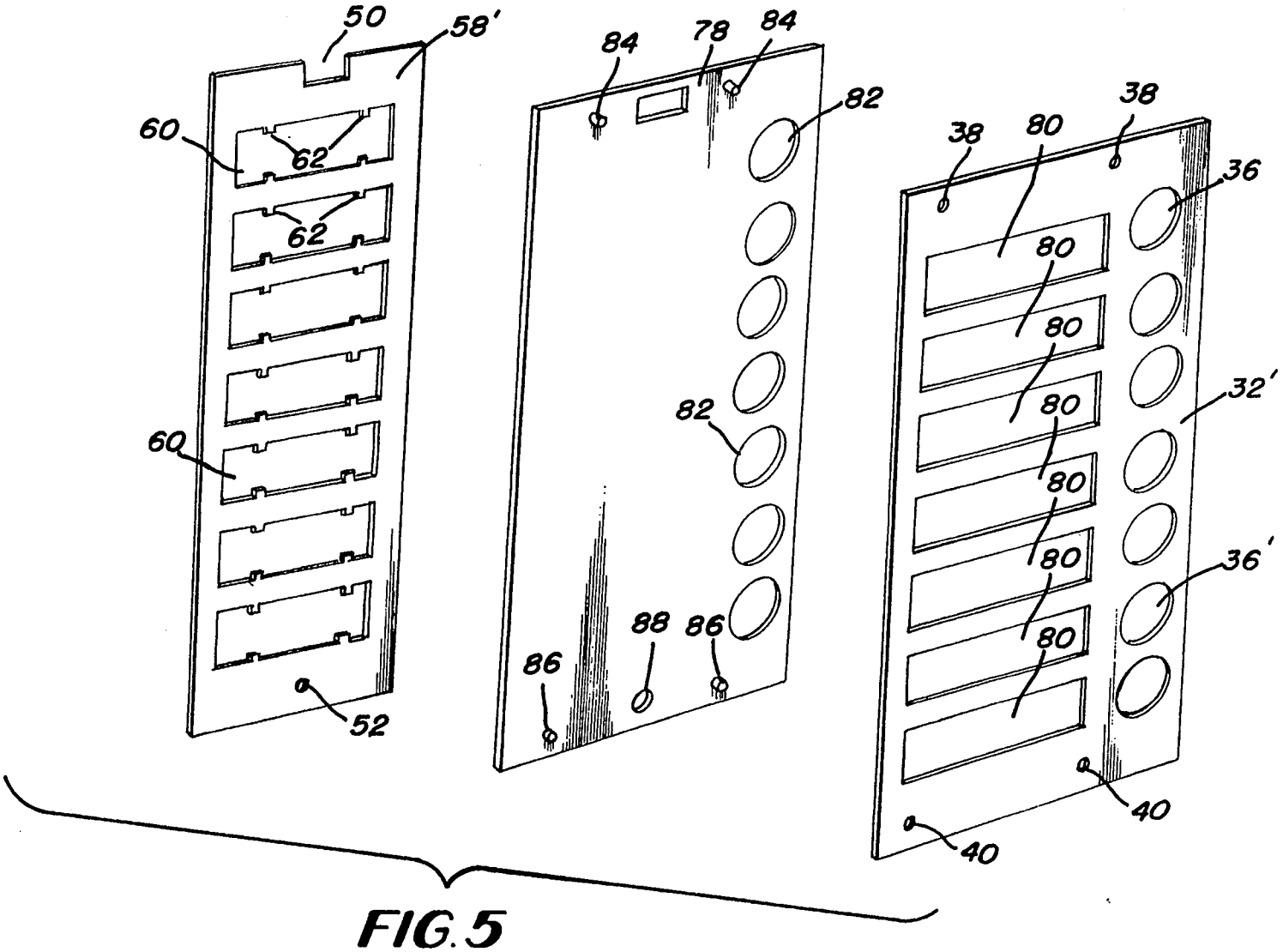
FIG. 5 is an exploded view of yet another preferred embodiment of the invention.

A third embodiment of the invention is shown in FIG. 5 and is comprised of a third element, i.e. a transparent flat plate or window member 78 located between the carrier member 58′ (FIG. 4) and a front panel member. The front panel is a modified front panel member 32′ as shown in FIG. 5, wherein the transparent window portions 34 of FIGS. 2 and 4 are replaced by rectangular openings 80 devoid of any material. Additionally, the window member 78 includes a vertical line of circular through-holes 82 which are adapted to be in registration with the push-button holes 36 in the front panel member 32′. The window member 78 also includes upper and lower pairs of forward projecting studs 84 and 86 which engage the holes 38 and 40 in the front panel member 32′. A small through hole 88 is located between the studs 86 in the window member 78 for the passage of the mounting stud 44 (FIG. 4) on the rear side of the front panel member 32′. When assembled together, the complete assembly can be mounted in a vending machine as before; however, since the carrier 58′ includes all the label retention details, the vending machine front selection panel 32′ is again simpler, stronger and more vandal resistant than before.

In still another embodiment of the present invention, panel 32′ of FIG. 5 could be fabricated from sheet metal. In such case, panel 32′ would be made from the same sheet of metal as the sidewalls of the recessed area 16 of FIG. 1.

Thus what has been shown and described is a vendor selection panel assembly including a carrier element which provides for separate areas for a package/price label and a product identification label which can be quickly and easily removed for label replacements. The inclusion of a separate label carrier allows for the possibility of constructing the front panel member of the assembly from a material such as polycarbonate sheet which exhibits greater resistance to vandalism than heretofore utilized. The carrier design also permits the unit to be used in a conventional single price environment. In this instance, the carrier is constructed of a darkened material and is used without a separate package size/price label. The resulting visual appearance is a product identification label surrounded by a darkened frame.

Having thus shown and described what is at present considered to be the preferred embodiments of the invention, it should be noted that the same has been made by way of illustration and not limitation. Accordingly, all modifications, alterations and changes coming within the spirit and scope of the invention as set forth in the appended claims are herein meant to be included.

We claim:

1. A product selection front panel assembly for a vending machine, comprising:

a damage resistant front selection panel for a vending machine and having a plurality of substantially equal sized, generally rectangular, mutually aligned label viewing windows for reading at least one indicia bearing label located behind said panel;

a label carrier member secured to a rear surface of said front selection panel, having a respective plurality of frame openings and label holding means in registration with said label viewing windows, said label holding means comprising a plurality of tab type elements selectively located around an inner perimeter edge of said frame openings;

said front selection panel further having a respective plurality of selector push button apertures arranged in a column adjacent said label viewing windows and said frame openings;

a generally flat transparent panel member located between said front selection panel and said label carrier member and including a plurality of selector push button apertures in registration with said push button apertures in said front selection panel; and means for holding said front selection panel, said label carrier member and said flat transparent panel member together.

2. A product selection front panel assembly for a vending machine, comprising:

a damage resistant front selection panel for a vending machine and having a plurality of substantially equal sized label viewing window sections for reading at least one pair of information related indicia bearing labels located behind said panel and a respective push button aperture located adjacent to one side of each said viewing window sections;

a generally rectangular label carrier frame member secured to a rear surface of said front selection panel and including a plurality of like pairs of adjacent mutually offset first and second sized frame openings in registration with a respective window section of said label viewing window sections and respective label holding means comprising a plurality of inwardly facing tabs projecting from said frame openings for holding said pairs of related indicia bearing labels in place on said frame member; and means for securing said label carrier frame member to said rear surface of said front selection panel, said means for securing including a pair of elements projecting outwardly from said rear surface of said front selection panel and a pair of apertures in said label carrier frame member for engaging said outwardly projecting elements of said front selection panel.

3. A product selection front panel assembly for a vending machine, comprising:

a damage resistant front selection panel for a vending machine and having a plurality of substantially equal sized, mutually aligned, transparent label viewing window sections for reading at least one pair of information related indicia bearing labels located behind said panel;

a generally rectangular label carrier frame member secured to a rear surface of said front selection panel and including a plurality of like pairs of frame openings in registration with said label viewing window sections, each said pair of frame openings including a first sized frame opening located immediately adjacent a relatively larger second sized frame opening, said frame openings further including respective label holding means in registration with said label viewing window sections for holding said labels in place on said frame member, and means for securing said label carrier frame member to said rear surface of said front selection panel, said means for securing including a pair of elements projecting outwardly from said rear surface of said front selection panel and a pair of apertures in said label carrier frame member for engaging said outwardly projecting elements of said front selection panel.

4. The front panel assembly of claim 3 wherein said elements projecting outwardly from the rear surface of said front selection panel includes a first element located on a top portion of said rear surface of said panel and a second member located on a bottom portion of said rear surface of said panel.

5. The front panel assembly of claim 4 wherein a first element of said elements projecting outwardly from the rear surface of said front selection panel comprises a mounting tab of generally rectangular cross section and said second member comprises a mounting stud of generally circular cross section and wherein said pair of apertures in said label carrier member includes a generally rectangular mounting notch in a top portion of said label carrier member and a mounting hole in a bottom portion of said label carrier member.

6. A product selection front panel assembly for a vending machine, comprising:

a damage resistant front selection panel for a vending machine and having a plurality of substantially equal sized, mutually aligned, transparent label viewing window sections for reading at least one pair of related indicia bearing labels located behind said panel, a generally rectangular label carrier frame member secured to a rear surface of said front selection panel and including a plurality of like pairs of first and second sized generally rectangular frame openings in registration with said label viewing sections, each pair of frame openings comprising a first sized frame opening located immediately adjacent and above a second relatively larger sized frame opening, said frame openings further including a plurality of tab type elements selectively located around respective inner perimeters of said frame openings in registration with said label viewing window sections for holding said labels in place on said frame member; and means for securing said label carrier frame member to said rear surface of said front selection panel, said means for securing including a pair of elements projecting outwardly from said rear surface of said front selection panel and a pair of apertures in said label carrier frame member for engaging said outwardly projecting elements of said front selection panel.

7. A product selection front panel assembly on a vending machine for viewing multiple pairs of information related translucent indicia bearing labels, comprising:

a damage resistant front selection panel having a plurality of substantially equal sized, mutually aligned, transparent label viewing window sections for reading said multiple pairs of information related translucent indicia bearing labels located behind said panel, a generally rectangular label carrier frame member for holding said labels secured to a rear surface of said front selection panel and including a plurality of like pairs of adjacent first and second sized generally rectangular and mutually parallel frame openings in registration with said label viewing sections of said front selection panel and including respective label holding means in registration with said label viewing sections for holding said pairs of indicia bearing labels in place on said label carrier frame member, said first and second sized frame openings further comprising a first sized frame opening located immediately adjacent a second relatively larger sized frame opening;

means for back lighting said label carrier frame member and said pairs of indicia bearing labels;

wherein said label carrier frame member is of a relatively darker color than a front surface of said front selection panel so as to provide a contrasting frame-like appearance for said indicia bearing labels when viewed, and wherein one label of each pair of said pairs of information related indicia bearing labels include product identification information and the other label of said pair includes product size/price information, said one label including product identification information and being relatively larger in size than said other label including product size/price information.

8. A product selection front panel assembly for a vending machine, comprising:

a damage resistant front selection panel having a plurality of substantially equal sized, generally rectangular, mutually aligned label viewing windows for reading indicia bearing label located behind said panel; and a respective plurality of selector push button circular apertures arranged in a column in said front selection panel immediately adjacent one side of said label viewing windows a label carrier member secured to a rear surface of said front selection panel and having a respective plurality of generally rectangular frame openings and label holding means in registration with said label viewing windows, said label holding means comprising a plurality of tab type elements selectively located around an inner edge of said frame openings; and means for holding said front selection panel and said label carrier member together, said means for holding including a pair of elements projecting outwardly from said rear surface of said front selection panel and a pair of apertures in said label carrier member for engaging said outwardly projecting elements of said front selection panel.

9. The front panel assembly of claim 8 and additionally including a generally flat transparent member located between said front selection panel and said label carrier member.

* * * * *

UNITED STATES PATENT AND TRADEMARK OFFICE

CERTIFICATE OF CORRECTION

PATENT NO. : 5,383,297

DATED : January 24, 1995

INVENTOR(S) : Don S. SUMMERVILLE et al

It is certified that error appears in the above-indentified patent and that said Letters Patent is hereby corrected as shown below:

Title page, item [54]; Col. 1, line 1:

IN THE TITLE:

Please change "ASSSEMBLY" to --ASSEMBLY--.

Signed and Sealed this

Fourth Day of July, 1995

Bruce Lehman

*Attest:*

BRUCE LEHMAN

*Attesting Officer*

*Commissioner of Patents and Trademarks*